US005150752A

United States Patent [19]

Gunst et al.

[11] Patent Number: 5,150,752

[45] Date of Patent: Sep. 29, 1992

[54] OIL WELL-FIRE CONTAINMENT DEVICE

[76] Inventors: Ole Gunst, 19475 Grand View Dr., Topanga, Calif. 90290; Gary R. Fisher, 2251 Federal Ave., Los Angeles, Calif. 90064

[21] Appl. No.: 690,168

[22] Filed: Apr. 22, 1991

[51] Int. Cl.[5] ..... E21B 35/00

[52] U.S. Cl. ..... 166/88

[58] Field of Search ..... 166/75.1, 82, 84, 86, 166/88; 169/69

[56] References Cited

U.S. PATENT DOCUMENTS

| | | | |
|---|---|---|---|
| 2,000,381 | 5/1935 | Duffy | 166/86 |
| 2,709,091 | 5/1955 | Rector | 166/88 |
| 3,797,864 | 3/1974 | Hynes et al. | 166/88 X |

*Primary Examiner*—Thuy M. Bui

*Attorney, Agent, or Firm*—Henry M. Bissell

[57] ABSTRACT

An apparatus for reaming and tapping an oil well casing and sealing the casing against escaping oil is disclosed. The apparatus comprises a self-tapping sleeve assembly the functions of which are to provide an internal seal to an oil well casing and cause cessation of escaping oil. In the process of capping the well, burning oil, if present, is simultaneously extinguished. Utilizing the present invention, there is no necessity of providing water to cool the wellhead prior to capping, no need to excavate reservoirs to contain oil after fire extinguishment, nor is there need to bring a crew to the well head until the well is capped and flow stopped.

18 Claims, 2 Drawing Sheets

OIL WELL-FIRE CONTAINMENT DEVICE

BACKGROUND OF THE INVENTION

1. Field of the Invention

This invention relates to the field of oil well fire-fighting technology and more specifically to a device and method for simultaneously extinguishing an oil well fire and capping the well without leakage.

2. Discussion of Related Art

Conventional approaches for extinguishing high pressure oil well fires and performing temporary well-capping operations require bringing a crew within close proximity to the burning wellhead to clear debris and prepare the casing for capping. This generally requires the delivery of large volumes of water to the site for use in cooling the wellhead perimeter and the crew. For sites removed from an available water supply, the overall containment time is thus increased directly by the time required to pipe water to the site or to build water reservoirs at the site and supply them.

Various means are conventionally used to extinguish the fire; explosives, water and chemical means have been the most prevalently used.

Once the fire is conventionally extinguished, the oil plume must be diverted to a pre-excavated containment reservoir prior to well capping if environmental pollution is to be minimized.

With the plume diverted, a temporary attachment to the well casing is made and drilling mud is pumped into the well to compensate the well pressure. In many instances this is also a time consuming operation. Once this is accomplished, the well can be capped and repaired by conventional technology.

The main drawback to the above methods is that they are containment-time intensive. In some instances wells have burned out-of-control for months before delivery systems were in place to perform the final crucial operations. Since containment time is directly related to revenue losses and environmental pollution consequences, apparatus and methodology that reduces containment time is highly desirable.

The present invention provides a viable alternative to conventional temporary well-capping and fire extinguishment technology as described above. Rather than requiring a crew to operate at the well-head perimeter, a device is disclosed which can be remotely positioned at the well casing and remotely operated to cap the well. Utilizing this device, no water is required to cool the wellhead, nor are explosives, water or chemicals required to extinguish the fire. Depending on well location, this can result in substantial reduction in overall containment time over conventional approaches.

The disclosed device accomplishes internal sealing of the casing. By sealing the sleeve internally to the well casing rather than externally, the necessity for clearing debris remaining on the outside of the casing (such as damaged valving) is obviated.

Internal sealing as embodied in the present invention is superior to prior temporary capping technology which relies on attachment of valving to the outside surface of the well casing. This is due to the capability of the internal seal of the present invention to withstand the full burst pressure of the well casing. Additionally, an internal seal as embodied in the disclosed device is not affected by deformations of the outer casing surface, nor must the casing be exposed above the terrain surface to effect sealing.

Advantageously, the disclosed device seals the well and then accomplishes fire extinguishment and capping by remote closure of an attached valve. Once the valve is closed, conventional approaches well known in the art can then be employed to bring the well on-line. Alternatively, piping can be connected directly to the valve to bring the well immediately on-line at reduced flow.

Another advantage of the present invention over prior technology is that minimal (if any) site preparation is required nor is there a need to excavate a containment reservoir to hold oil during well capping.

Another advantage of the present invention is that the escaping oil lubricates and cools the tooling sleeve of the disclosed device. This is facilitated by channeling the plume so that it burns above the tooling sleeve, allowing relatively cool upward sub-surface oil to cool the sleeve.

SUMMARY OF THE INVENTION

The invention provides a device for reaming and tapping an oil well casing and sealing the casing against escaping oil.

In the embodiment of the invention a self-tapping sleeve is disclosed, the function of which is to provide an internal seal to an oil well casing thus stopping the flow of oil from the casing and extinguishing a well-fire simultaneous with cessation of flow.

The apparatus includes a self-tapping sleeve assembly with an insertion region, casing reaming region, tapping region, and sealing region. A valve coupled with the sleeve assembly is employed to cap the well after the sleeve is sealed to the interior wall of the well casing. Rotatable means drive the sleeve during sealing of the casing.

A method is disclosed to seal and cap the well utilizing the disclosed apparatus.

BRIEF DESCRIPTION OF DRAWINGS

A better understanding of the present invention may be realized from a consideration of the following detailed description, taken in conjunction with the accompanying drawings in which.

DESCRIPTION OF THE PREFERRED EMBODIMENT

Figure 1:
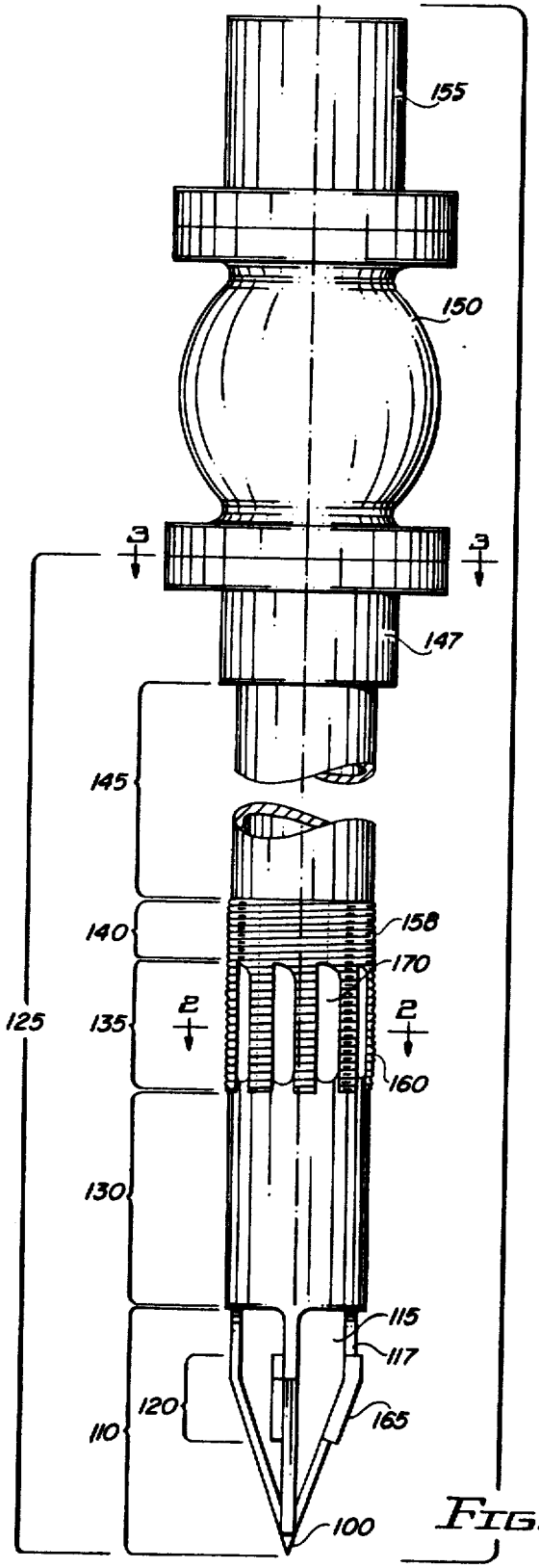
FIG. 1 is a side elevation of the self-tapping sleeve assembly.

FIG. 1 shows the self-tapping sleeve assembly. The purpose of the sleeve assembly is to provide a means of reaming and tapping the well casing, sealing the well and simultaneously extinguishing the burning oil well fire, thus stopping the escape of oil from the well. As shown in the figure, the self-tapping sleeve assembly 125 is comprised of an insertion region 110, a reaming region 120, an alignment guide region 130, a self-tapping region 135, a sealing region 140, a sleeve extension region 145, and a valve coupling flange 147. The valve coupling flange is operatively connected to a valve 150, and a valve-to-turntable adaptor 155. Each of these elements of the device shall be described in order, beginning with the insertion region 110.

The insertion region 110 comprises an essentially conical structure with flutes 115 to channel upward moving oil exiting the well casing into an internal recess 200 (see FIG. 4) in the sleeve. For descriptive purposes, three flutes are shown although it should be understood that the structure as shown can be modified to provide a different plurality of flutes in insertion region 110. Internal recess 200 runs the length of the self-tapping sleeve 125 and communicates with a similar recess in the valve-to-turntable adaptor 155, thus providing a straight-through axial path for oil through the length of the device depicted in FIG. 1.

Figure 4:
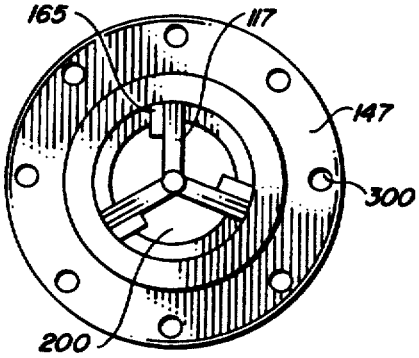
FIG. 4 is an end view of the sleeve assembly.

The reaming region 120 comprises cutting edges 165 operatively attached to webs 117, as shown in FIG. 1 and FIG. 4. The purpose of the reaming region is to correct for minor deformations of the interior casing wall and to insure that the casing is cylindrical and of standard diameter at the depth wherein final tapping and sealing are to occur.

The alignment guide region 130 is circular in cross-section with an annular opening extending axially through the length of 130. The length and diameter of the guide region is chosen to insure that when the sleeve is inserted into the casing to a depth beyond the guide region, sleeve assembly 125 will be essentially concentric with the axis of the well casing.

Figure 2:
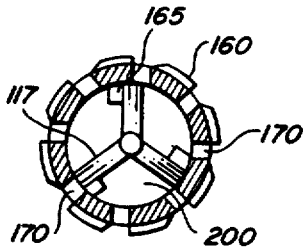
FIG. 2 is a cross-sectional view of the self-tapping region of the self-tapping sleeve.

A cross-sectional view of the self-tapping region 135 is shown in FIG. 2. With reference to FIGS. 1-2 the self tapping region comprises tapping-threads 160 with flutes 170 defining multiple chip-removal slots oriented radially around the circumference of the region and extending into the annular recess 200 of the sleeve. The tap threads are chosen so that when the tapping-region is tapped into the well casing, sufficient area will be developed to resist the maximum force of the oil (times 2 for safety factor) when the well is sealed. The preferred thread is of the buttress form.

The function of the chip-removal slots in the self-tapping region of the sleeve is to provide channels which communicate with the upward oil stream internal to the sleeve, for elimination of chips developed during tapping of the casing. This elimination is facilitated by turbulent flow at the boundaries of the channels with the interior wall of the sleeve While eight flutes defining the chip removal slots are shown in FIG. 2, it should be understood that a different plurality of flutes, not necessarily eight, can alternatively be specified.

The sealing region 140 in FIG. 1 is threaded with threads 158 and has an annular cross-section defining an internal recess in the sealing region, to allow for internal flow of upward oil. The pitch diameter of threads 158 is slightly greater than the pitch diameter of tapping threads in the self-tapping region to insure an interference fit. Preferably the pitch diameter in the threaded region is 0.003-inches greater than tapped for in order to facilitate sealing of the threads in the well casing.

The sleeve extension region 145 is annular in cross-section with outside diameter slightly less than the inside diameter of the casing. The length of the sleeve extension is dictated by the depth below the top of the well casing (or the surface of the terrain) that it is anticipated must be reached before the interior wall of the well casing can be considered un-damaged and of circular cross-section.

Figure 3:
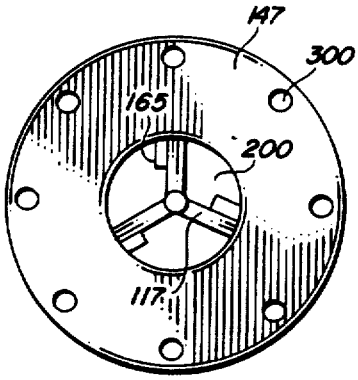
FIG. 3 is a cross-sectional view of the valve coupling flange.

The valve coupling flange 147 mates sleeve assembly 125 to valve 150. FIG. 3 is a cross-section at the interface between the valve coupling flange and the valve, showing internal recess 200 for channeling oil within the flange. Flange 147 is configured with mounting holes 300 to operatively connect a specified valve to sleeve assembly 125.

The function of valve 150 in FIG. 1 is to provide a means of shutting off the flow of oil and extinguishing the well-fire after the self-tapping sleeve is sealed to the well casing. Preferably the inside diameter of the valve should be slightly larger than the inside diameter of oil flow channel 200 in the self-tapping sleeve, to minimize flow-reduction if it is desired to bring the well on-line before extensive field modifications are made to the casing.

Figures 5, 6, 7, 8:
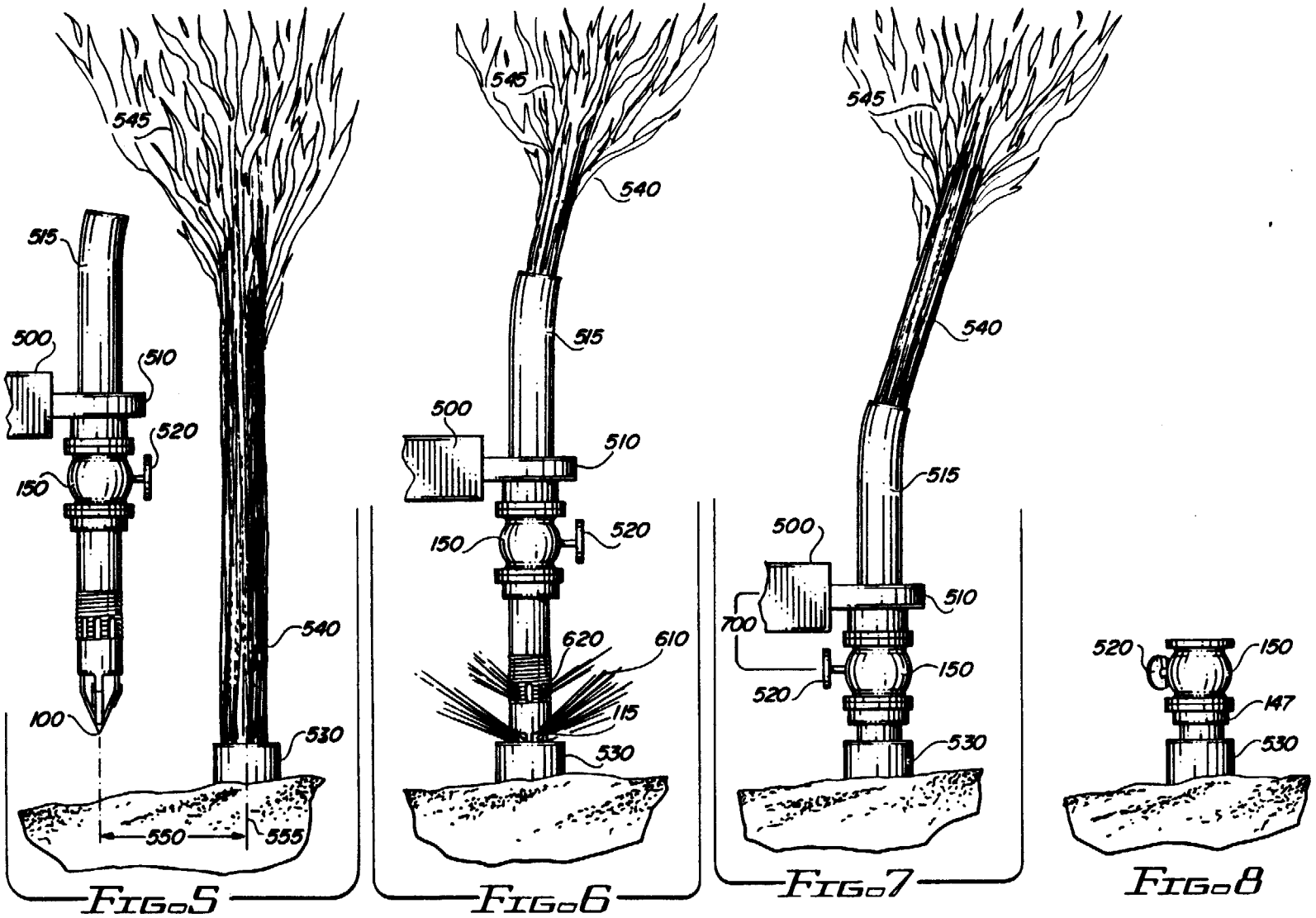
FIG. 5 is a side elevation view of the delivery system positioned at the perimeter of the wellhead, showing attachment of the self-tapping sleeve assembly to the turntable and delivery boom, and illustrating a nominally vertical burning plume of oil exiting the well casing.
FIG. 6 is a side elevation view of the delivery system illustrating the insertion portion of the self-tapping sleeve assembly partially inserted into the well casing and further illustrating the plume exiting the chimney and oil spray diverted through flutes of the insertion tip.
FIG. 7 is a side elevation view of the delivery system illustrating the self-tapping sleeve in its sealed position in the well casing.
FIG. 8 is a side elevation view of the self-tapping sleeve assembly with the well casing sealed, the well capped, fire extinguished and boom and turntable removed.

As shown in FIG. 1, a valve-to-turntable adaptor 155 is provided to mate with the valve specified for the self-tapping sleeve assembly and to interface with a turntable and delivery boom. This interface is illustrated in FIG. 5. By reference to the figure, turntable 510 provides rotatable means to rotate the self-tapping sleeve assembly around an axis coincident with the central axis of the sleeve assembly. As with the sleeve assembly, an annular opening concentric with and of equal diameter to channel 200 is provided to afford a path for oil forced through the self-tapping sleeve assembly. As is shown in FIG. 5, the turntable is operatively connected to boom 500. While not shown in the figure, the boom is preferably structured to minimize weight and should be of sufficient rigidity to resist the upward force of the oil when the sleeve assembly is introduced into the oil plume 540 exiting well casing 530. The boom 500, in turn, is operatively connected to a delivery vehicle (not shown).

Boom 500 is capable of movement in a direction toward the well (y-axis), transverse to the well (x-axis), and in a direction parallel to the oil plume (z-axis). The boom is additionally capable of tilting about the x-axis and y-axis. These degrees of freedom are necessary so that the self-tapping sleeve assembly can be oriented such that the tip 100 of the insertion region (110 in FIG. 1) can be moved to a position coincident with the axis 555 of the well casing. It should be noted that one or more of the required degrees of freedom can be provided by the delivery vehicle (not shown).

Above the turntable, a non-rotatable hollow chimney 515, operatively connected to the turntable 510 and concentric with the axis 555 of the sleeve assembly, is provided to direct the oil plume exiting the turntable. As shown in FIG. 5, the chimney is slightly curved so as to direct the oil plume in a direction away from the boom and operatively connected delivery vehicle.

A method of capping a well and extinguishing the oil-fire will now be described with reference to FIGS. 5–8. FIG. 5 shows the delivery system positioned at the perimeter of the wellhead with oil plume 540, for descriptive purposes, exiting the casing in a nominally vertical direction and burning 545 at some elevation above the casing. As is shown in FIG. 5, the self-tapping sleeve assembly (125 in FIG. 1) is operatively coupled to boom 500 which is coupled to a delivery vehicle (not shown). In FIG. 5, valve 150 is assumed to be fully open. As shown in FIG. 5, insertion tip 100 of the sleeve assembly is in close proximity to the well casing at a distance 550 from it. For purposes of this description it is assumed that the delivery vehicle has moved the assembly in FIG. 5 to the position shown, and that sensor means (i.e. a machine-vision system) have been employed to orient the insertion tip 100 in x-axis and y-axis such that insertion tip 100 is parallel to axis 555 of the well casing and aligned in x-axis and y-axis to it. Further it is assumed that sensor means have been employed to determine the distance 550 along the y-axis from the tip of the sleeve assembly to the axis 555 of the casing. To negate possible heat-induced damage to the boom, delivery vehicle and vehicle operator, the delivery vehicle and boom are heat shielded.

Once correct positioning is attained as illustrated in FIG. 5, the boom is moved rapidly in the y-direction by distance 550. The boom is then moved downward in the z-axis until the tip 100 of the self-tapping sleeve enters the well casing. This condition is shown in FIG. 6. As shown in the figure, the oil plume is routed through the self-tapping sleeve assembly (125 in FIG. 1), the annular opening in the turntable 510, and chimney 515. Immediately above the chimney, the non-ignited oil 540 is diverted away from boom 500 while remaining ignited 545 at some elevation above the chimney.

As shown in FIG. 6, a small amount of upward-moving oil 610 is forced through flutes 115 and exits radially around the circumference of the casing. Minor leakage of oil 620 is also shown exiting the chip removal slots in the self-tapping region of the sleeve assembly. While not shown in the FIG. 6, boom 500 can be slightly tilted with respect to the y-axis prior to tip 100 insertion, to reduce the force against the sleeve assembly of the upward-moving oil.

Turntable 510 rotation is then initiated radially around the z-axis. This causes the sleeve to progressively ream and tap the well casing and screw itself into the casing wall.

Since for sealing to be effective, the sealing region of the casing must be un-damaged and of pre-damage circular cross-section, rotation of the turntable should continue until oil is not observed to be leaking from the top of the casing.

At this stage, rotation of the turntable is continued until turntable torque closely approaches a pre-determined value necessary to insure interference-fit threading, and valve handle 520 is parallel to the boom. This is shown in FIG. 7, wherein the well is essentially sealed and valve handle 520 is in alignment 700 with the boom, preparatory to closure.

Utilizing a remote manipulator (not shown) coupled to boom 500, valve 150 is slowly closed until oil ceases to flow from chimney 515. It is important to note that slow closure of the valve is essential to prevent a downhole pressure wave from forming and possibly causing a below-ground blowout of the well casing.

After valve 150 is closed, turntable 510 is caused to further rotate until the required torque condition for interference-fit is met. At this stage the well is sealed and capped, escaping oil contained and fire extinguished.

After allowing time for the perimeter of the wellhead to cool sufficiently for personnel to approach the well casing, the valve-to-turntable adaptor 155 [see FIG. 1] is removed from valve 150 and the delivery vehicle backed away from the wellhead. The final condition of the capped well casing is shown in FIG. 8.

Other modifications to the disclosed embodiment and method can be made without deviating from the scope of the invention.

For instance, for blowouts or oil well explosions where the upper section of the casing is destroyed and intact casing is some distance below ground, a self-tapping sleeve with a suitably long sleeve extension region (145 in FIG. 1) can be employed to seal and cap the well.

In instances where the top segment of the casing is severely deformed either by blowout or by sabotage, a two-stage capping operation can be employed. A reaming sleeve with an insertion region of reduced diameter, however with increased structural webbing, and an elongated sleeve extension region, could be coupled to the turntable of the present invention and used to prepare the casing for subsequent sealing by the apparatus embodied in the present invention.

In order to compensate for deviations from ideal alignment of the insertion region of the self-tapping sleeve assembly during tip insertion, the valve-to-turntable adaptor can be configured to allow constrained slidable and gimbaling motion in the x-axis and y-axis. This would facilitate the self-centering of the sleeve assembly by virtue of the forces generated by the upward stream of oil exiting the casing and would reduce the degrees of freedom needed by the delivery system.

For instances where the outside of the casing is undamaged and extends above the terrain surface, a sleeve comprising a threading and sealing die coupled to flange 147, an alignment guide 130 and an insertion region 110 without reaming edges, can be alternatively used to effect a seal to the external casing wall.

Although there have been shown and described hereinabove a specific embodiment of a well-fire containment device in accordance with the invention for the purposes of illustrating the manner in which the invention may be used to advantage, it will be appreciated that the invention is not limited thereto. Accordingly, any and all modifications, variations, or equivalent devices which may occur to those skilled in the art should be considered to be within the scope of the invention as defined in the annexed claims.

What is claimed is:

1. An apparatus for reaming, tapping and sealing an oil well casing against escaping oil comprising:

a sleeve with insertion means for introducing the sleeve into a well casing;

reaming means for preparing the casing for tapping;

alignment guide means for aligning said sleeve with said casing;

tapping means for tapping the casing;

threading means for threading said sleeve into said casing;

sleeve extension means for controlling the depth of the sleeve seal in said casing;

a valve-to-sleeve adaptor coupled to the sleeve;

a valve, detachably coupled to the valve-to-sleeve adaptor, for closing the casing opening after the sleeve is attached to the casing;

a valve-to-turntable adaptor, coupled to the valve; and a turntable, detachably coupled to the valve-to-turntable adaptor, for driving the sleeve into threaded engagement with the well casing.

2. The apparatus of claim 1, wherein said sleeve has means defining an essentially annular channel for providing a path for the upward oil stream from the well casing.

3. The apparatus of claim 1, wherein the insertion means comprise an essentially conical structure with web means defining flutes for channeling said oil stream into said channel in the sleeve.

4. The apparatus of claim 1, wherein the reaming means comprise a plurality of cuttings edges operatively attached to said web means for preparing the casing for tapping.

5. The apparatus of claim 1, wherein the alignment guide means comprise a cylindrical region of length and outside diameter sufficient for aligning the sleeve coincident with the axis of the well casing.

6. The apparatus of claim 1, wherein the tapping means comprise a threaded section of said sleeve for tapping said casing and means defining a plurality of slots oriented along the axis of said sleeve and communicating with said annular channel for removal of chips generated during tapping of the casing.

7. The apparatus of claim 1, wherein the threading means comprise a cylindrical region with threads for sealing the sleeve with in the casing wall.

8. The apparatus of claim 1, wherein the sleeve extension means comprise an essentially cylindrical annular tube with outside diameter slightly less than the inside diameter of said casing and of length sufficient for said tapping and sealing means to reach an undamaged section of said well casing.

9. The apparatus of claim 1, wherein the turntable means comprises rotatable means for rotating the sleeve concentrically in the well casing and thereby operatively allow reaming, threading, and sealing of the casing.

10. The apparatus of claim 1, wherein the valve has means for shutting off the flow of oil in the sleeve and thereby effecting containment of the well.

11. The apparatus of claim 1, wherein the valve-to-sleeve adaptor comprises coupling means for connecting the valve to the sleeve.

12. The apparatus of claim 1, wherein the valve-to-turntable adaptor comprises means for connecting said valve to said turntable.

13. Apparatus for capping a hydrocarbon products well having a well casing which is generally open at the top and flowing oil and/or gas, the apparatus comprising:

a self-tapping sleeve assembly including a generally cylindrical sleeve terminating in a tapered, partially open insertion portion at a distal end and having a proximal end for coupling to a valve;

said sleeve having a self-tapping portion adjacent a sealing portion, said self-tapping portion and sealing portion having external threads extending continuously through said regions, said self-tapping portion being spaced from the distal end by an alignment guide portion; and means for rotating the sleeve assembly about a central longitudinal axis to, in succession, ream the opening of a well casing to remove surface irregularities and render the casing generally cylindrical, create internal threads in a portion of the well casing accessible to the sleeve assembly, and thread the sealing portion of the sleeve into sealing engagement with the threads created in the open end of the well casing to sealingly attach the sleeve assembly to the well casing.

14. The apparatus of claim 13 wherein said insertion portion includes means defining a plurality of openings communicating with the hollow bore of the said sleeve.

15. The apparatus of claim 14 wherein said insertion portion further includes means supporting a plurality of members having cutting edges for reaming the interior of the well casing.

16. The apparatus of claim 14 wherein said opening defining means comprise a plurality of longitudinal web members extending from the alignment portion of the sleeve which are joined together at a point at the distal end of the sleeve.

17. The apparatus of claim 16 wherein said web members support a corresponding plurality of reaming members in an orientation such that the cutting edges are directed outwardly for contact with the interior of the well casing.

18. The apparatus of claim 13 wherein the self-tapping portion includes means defining a plurality of flutes communicating with the interior bore of the sleeve.

* * * * *